US008857108B2

(12) United States Patent
Smeja

(10) Patent No.: US 8,857,108 B2
(45) Date of Patent: Oct. 14, 2014

(54) SNOW BARRICADE MOUNTING SYSTEM AND METHOD OF MOUNTING SAME

(71) Applicant: Michael V. Smeja, Inverness, IL (US)

(72) Inventor: Michael V. Smeja, Inverness, IL (US)

(73) Assignee: Sno-Gem Incorporated, McHenry, IL (US)

( * ) Notice: Subject to any disclaimer, the term of this patent is extended or adjusted under 35 U.S.C. 154(b) by 0 days.

(21) Appl. No.: 13/895,946

(22) Filed: May 16, 2013

(65) Prior Publication Data

US 2013/0305622 A1 Nov. 21, 2013

Related U.S. Application Data

(60) Provisional application No. 61/648,014, filed on May 16, 2012.

(51) Int. Cl.
*E04D 13/00* (2006.01)
*E04D 13/10* (2006.01)

(52) U.S. Cl.
CPC ..... *E04D 13/10* (2013.01)
USPC ..... 52/26; 52/24

(58) Field of Classification Search
USPC ..... 52/24, 26
See application file for complete search history.

(56) References Cited

U.S. PATENT DOCUMENTS

| | | | | |
|---|---|---|---|---|
| 5,609,326 | A | 3/1997 | Stearns et al. | |
| 6,526,701 | B2 | 3/2003 | Stearns et al. | |
| 8,122,648 | B1 * | 2/2012 | Liu | 52/58 |
| 2011/0258947 | A1 * | 10/2011 | Peterson | 52/213 |

OTHER PUBLICATIONS

Alpine SnowGuards®, Installation Instructions for #90 Snow Guard [online]. alpinesnowguards.com [Dated Feb. 15, 2010]. Retrieved from the Internet: <URL:http://www.alpinesnowguards.com>, 3 pages.

Alpine SnowGuards®, Installation Instructions for #215 Snow Guard [online]. alpinesnowguards.com [Dated May 24, 2010]. Retrieved from the Internet: <URL:http://www.alpinesnowguards.com>, 3 pages.

Alpine SnowGuards®, Installation Instructions for #115 Snow Guard, #115 Pipe-Style Snow Guard Data & Drawings [online]. alpinesnowguards.com [Retrieved on Mar. 21, 2012]. Retrieved from the Internet: <URL:http://www.alpinesnowguards.com/our-products/pipe-style-snow-guards/38>, 5 pages.

* cited by examiner

*Primary Examiner* — Mark Wendell
(74) *Attorney, Agent, or Firm* — Neal, Gerber & Eienberg LLP

(57) ABSTRACT

A snow barricade mounting system for use with a membrane roof system is provided. The system includes a bracket having a base plate and an upstanding arm, and a means for securing the bracket to membrane roof. The system further comprises a membrane patch comprised of a material corresponding to the membrane layer. In one embodiment, bracket is coated with a material corresponding to the membrane layer and the membrane patch, such that when membrane patch is secured a complete seal between both the membrane patch and the base plate, and between the membrane patch and the membrane layer, is achieved. In an alternative embodiment, a sheet of material corresponding to the membrane layer material is secured to the top side of the base plate. A method of securing a snow barricade mounting system to a membrane roof system is also provided.

15 Claims, 8 Drawing Sheets

SNOW BARRICADE MOUNTING SYSTEM AND METHOD OF MOUNTING SAME

CROSS-REFERENCE TO RELATED APPLICATION

This application claims priority from U.S. Provisional Patent Application Ser. No. 61/648,014, filed May 16, 2012, which is incorporated herein by reference.

BACKGROUND

Snow barricade systems are generally mounted on roofs to prevent snow loads from falling from the roof. These barricade systems generally include roof mounts for mounting the barricades on the roof. Roof mounts are known for attaching to various types of roofs and roofing materials, including seamed or metal roofs, wood roofs and membranous roofs. Prior art which describe systems for use with membranous roofs include U.S. Pat. Nos. 5,609,326 and 6,526,701. U.S. Pat. No. 5,609,326 discloses the use of a bracket plate for mounting to wood decking below a membrane roof and a membrane patch with a slit to accommodate the spline of bracket plate, wherein the membrane patch is placed over the bracket plate and sealed to the membrane roof layer around the perimeter of the bracket plate. U.S. Pat. No. 6,526,701 discloses a base member secured to the roof with spacers to accommodate insulation, a membrane patch placed over the base member with bolts extending through patch holes, the membrane patch secured to membrane layer around the perimeter of the base member leaving bolts exposed, and a mount member secured to the base member using the bolts to compress membrane patch around bolt protrusions. Existing art only provides for a seal between a membrane patch and the membrane layer around the perimeter of a bracket base plate, but does not provide for sealing between the membrane patch and the base plate. Such existing systems expose the roof to leakage, as water can seep under the patch through the patch notch needed to accommodate bracket arm. As a result, such systems are generally not covered by the roofing manufacturer's warranty.

SUMMARY

The present invention solves the existing limitations. The present invention relates to a system and method for mounting a snow barricade on a roof to prevent snow loads from falling from the roof. In particular, the present invention provides a snow barricade mounting system for use with a membrane roof system having a membrane layer, wherein the system maintains the leak-proof seal provided by the membrane layer. A mounting system is disclosed wherein a bracket for securing to wood decking below the membrane roof is coated in a material corresponding to the membrane layer material and to the membrane patch material, such that membrane patch can be welded to both the bracket itself and the membrane layer around the perimeter of the base plate to provide a completely sealed mounting system.

In a preferred embodiment, bracket is coated in PVC or other material corresponding to the membrane layer material. Bracket comprises a base plate for mounting to the bracket to the roof, and an upstanding arm with one or more apertures through which tubing can be inserted for barricading snow loads. Bracket is positioned on top of membrane layer over an area of wood blocking located below the membrane layer. Base plate of bracket includes a plurality of holes, and bracket is secured to wood blocking using fasteners inserted through holes which penetrate the membrane layer and the wood blocking and secure into the metal roof deck. In one embodiment, a membrane patch comprised of a material corresponding to the membrane layer material is placed over the bracket, with a notch removed from the membrane patch allowing the arm of the bracket to fit through the notch. Membrane patch is then hot-air welded to the coated base plate and the membrane layer around the perimeter of the base plate, providing a complete seal of the mounting system to the membrane roof to prevent leakage of water into the system and below the membrane roof. In another embodiment, bracket is coated in PVC or other material and portion of a membrane patch is secured to a portion of the base plate of the coated bracket, before mounting, such that bracket is provided to users with the pre-applied membrane patch. Bracket with the attached patch is secured to roof using fasteners, and a user then hot-air welds the unattached surface of the pre-applied membrane patch to the remaining area of the coated base plate and the membrane layer around the perimeter of the base plate.

In a further alternative embodiment, top surface of base plate of bracket is cladded with a layer of PVC or other material corresponding to the membrane layer material. A portion of a membrane patch is then secured to a portion of the cladded base plate, before mounting, such that bracket is provided to users with the pre-applied membrane patch. Bracket with the attached patch is secured to roof using fasteners, and a user then hot-air welds the unattached surface of the pre-applied membrane patch to the remaining area of the cladded base plate and the membrane layer around the perimeter of the base plate.

Other objects, advantages, features, properties and relationships of the invention will be obtained from the following detailed description and accompanying drawings which set forth illustrative embodiments that are indicative of the various ways in which the principles of the invention may be employed.

DETAILED DESCRIPTION

The description that follows describes, illustrates and exemplifies one or more embodiments of the present invention in accordance with its principles. This description is not provided to limit the invention to the embodiments described herein, but rather to explain and teach the principles of the invention in order to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

Figure 1:
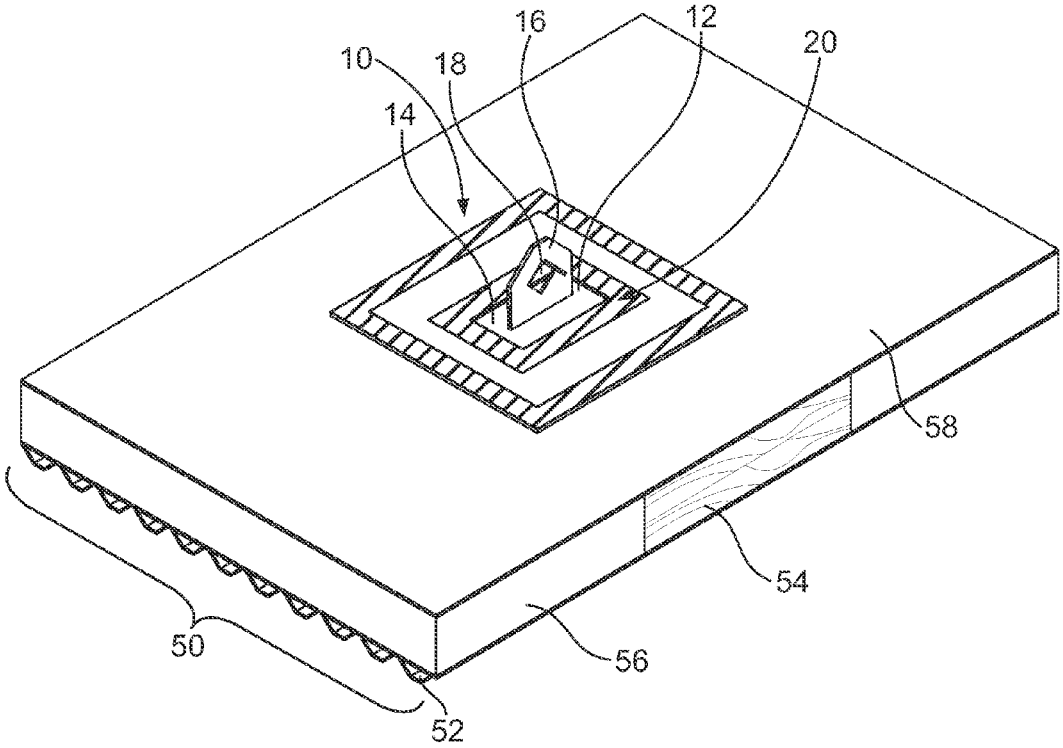
FIG. 1 is a perspective view of one embodiment of a mounting system installed on a roof system in accordance with the present invention.

FIGS. 1-5 show a preferred embodiment of a snow barricade mounting system 10. FIG. 1 shows a snow barricade mounting system 10 installed on a membrane roof system 50. Mounting system 10 is designed for use with membrane roofing systems. Membrane roofing is generally used on flat or nearly flat roofs to prevent leaks and to move water off the roof. Membrane roofs are most commonly made from synthetic rubber, thermoplastic (PVC or similar material) or modified bitumen, and the present invention is designed for use with thermoplastic membrane roofing. While the components and construction of membrane roofs may vary, they generally comprise the components shown in FIG. 1, namely, metal decking 52 placed over the top frame of the building (not shown), continuous wood blocking 54 running along the length and/or width of the roof, insulation 56 filling the areas around the wood blocking 54, and a leakproof thermoplastic membrane layer 58 comprised of PVC or similar material.

Figure 2:
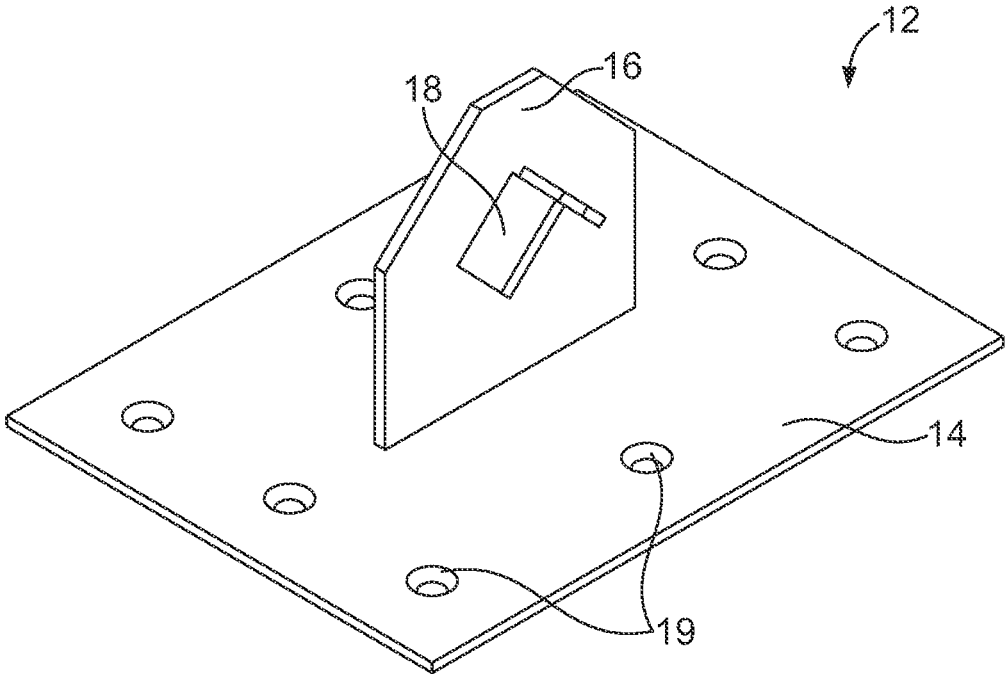
FIG. 2 is a perspective view of a bracket as used with the embodiment of the mounting system of FIG. 1.
Figure 3:
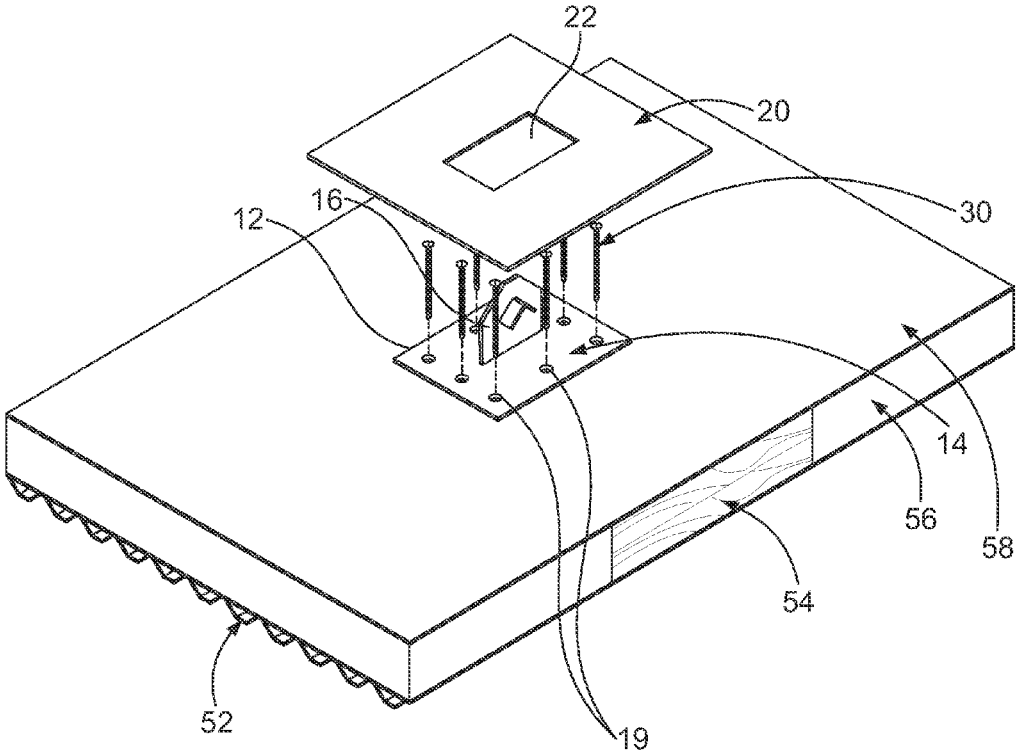
FIG. 3 is an exploded view of the embodiment of the mounting system shown in FIG. 1.

Referring now to FIGS. 1-3, a preferred embodiment of a mounting system 10 includes a bracket 12, a membrane patch 20 and fasteners 30. As shown in FIG. 2, bracket 12 comprises a base plate 14 adapted to lie against membrane layer 58 of roof system 50, and an arm 16. Bracket 12 is made of stainless steel or other similar material. To form bracket 12, a generally vertical or upstanding arm 16 may be welded or similarly attached to base plate 14. Base plate 14 further comprises one or more holes 19 for securing bracket 12 to roof system 50. Base plate 14 of bracket may have various shapes and include varying numbers of holes 19.

Fasteners 30 should be selected according the particular specifications of the roof system 50, such that fasteners 30 are of appropriate length to penetrate membrane layer 58 and wood blocking 54 and secure into roof deck 52. One type of preferred fastener 30 is a Heavy Duty Profiler fastener in stainless steel ranging from 2" up to 8" in length, depending on the dimensions and specifications of the components of the roof system 50 into which the fasteners 30 are being fastened. In a preferred embodiment, to secure bracket 12 to roof system 50, fasteners 30 are inserted through holes 19 in base plate 14 and penetrate through membrane layer 58 and wood decking 54 to secure into roof deck 52.

Arm 16 includes one or more apertures 18 through which tubes are inserted to form a snow barricade. Apertures 18 may vary in diameter and shape to accommodate various sizes and shapes of tubes for inserting therethrough. A plurality of mounting systems 10 are generally installed parallel to the edge of roof system 50, and a tube (not shown) is inserted through aperture 18 in bracket 12 to form a snow barricade parallel to the edge of the roof for preventing snow loads from falling from the roof. To accommodate varying degrees of slope of the roof system 50 on which bracket 12 is fastened, arm 18 may be configured at a different angles to the base plate 14.

Membrane patch 20 can vary in size and shape, but generally has perimeter dimensions greater than the perimeter dimensions of base plate 14 and a notch 22 for allowing arm 18 to protrude therethrough. Membrane patch 20 may be formed either by the contractor in the field of work cutting the notch 22 out to fit around arm 18, or by an automated machine which cuts individual patches 20 which included notches 22 therein. When membrane patch 20 is fitted over bracket 12, with the arm 18 of bracket 12 protruding through notch 22, the membrane patch 20 covers the perimeter of the base plate 14 and portions of the membrane layer 58 around the perimeter of the base plate 14. In one embodiment, membrane patch 20 may extend over the perimeter of the base plate 14 approximately 2.5 inches. Membrane patch 20 is preferably comprised from the same material as the membrane layer 58, or if approved by the manufacturer of the roof system 50, a compatible material to membrane layer 58 material. In another embodiment (not shown), a portion of a membrane patch is secured to a portion of the sheet on base plate. The bracket is thus provided to users with the pre-applied membrane patch already secured to the bracket. The unsecured portion of the membrane patch can be folded up by the installer to expose the holes in base plate for securing the base plate to the roof. Bracket is secured to roof using fasteners, and a user then hot-air welds the remaining surface of the pre-applied membrane patch to the remaining area of the coated base plate and the membrane layer around the perimeter of the base plate. This provides an additional advantage, as the user only need install a single assembly (bracket with pre-applied membrane patch) to the roof system.

Bracket 12 including arm 18 is coated with a material corresponding to the membranous layer 58 material. For example, if membrane layer 58 of roof system 50 is comprised of PVC material, bracket 12 is dipped in a PVC material. Preferred materials for coating the bracket include polyvinyl chloride (PVC) or Plasticol, and thermoplastic polyolefin (TPO). These material compounds can be customized to achieve hardness, flexibility, color, surface appearance, abrasion resistance, flame retardation, insulation and other desired characteristics to meet customer specifications. One method of coating the bracket 12 in PVC material consists of coating the bracket 12 using in a fluidized bed of PVC powder (such as DURAVIN BDG-1V sold by Thermoclad Company). The bracket 12 is first cleaned to remove any soil, oil, or other foreign debris. The bracket 12 is dried off in an oven, and then a solvent-based primer is applied to the bracket 12. This provides for adhesion of the PVC coating to the metal substrate. Once ready for coating, the bracket 12 is preheated to approximately 450 F and then dipped in the PVC powder material. The coated bracket 12 is then put through a second oven to flow out and cure the PVC coating. The bracket 12 is then cooled and is ready to be packed for shipment and use with mounting system 10.

FIG. 3 shows a preferred method for installing a mounting system 10 to a roof system 50. To install mounting system 10 onto roof system 50, coated bracket 12 is positioned on top of roof system 50 above a section of wood blocking 54 located below the membrane layer 58. Base plate 14 is fastened to roof system 50 by inserting fasteners 30 through holes 19 in base plate 14, the fasteners penetrating the membrane layer 58 and the wood blocking 54 and securing into the metal roof deck 52. After bracket 12 is secured to roof system 50, membrane patch 20 is placed over the bracket 12 with the notch 22 positioned over the arm 16. Membrane patch 20 is sized to cover all fasteners 30 and the entire perimeter of the base plate 14 and to extend onto the membrane layer 58 around the entire perimeter of the base plate 14. Membrane patch 20 is then secured to the coated base plate 14 and to the membrane layer 58 around the perimeter of the base plate 14, providing a complete seal of the mounting system 10 to the membrane roof 50 to prevent leakage of water into the system and below the membrane layer 58 to the insulation 56 and metal decking 52. One method of securing membrane patch to coated base plate 14 and membrane layer 58 in a corresponding materials is through hot-air welding. Hot-air welding is performed in the field with what is commonly known as a leister gun and a roller to complete the weld on both the inner weld on the base plate 14 and the outside weld of the patch 20 to the membrane layer 58.

Coating bracket 12 with material corresponding to the membrane patch 20 provides an advantage over existing systems because a complete seal can be achieved between mounting system 10 and roof system 50. When membrane patch 20 is secured to base plate 14 and to membrane layer 58 around the perimeter of the base plate 14, a complete seal between both the membrane patch 20 and the base plate 14, and between the membrane patch 20 and the membrane layer 58, are achieved. The entire area of the underside of the membrane patch 20 is thus sealed to a surface below (either base plate 14 or membrane layer 58). This provides a more complete seal than that of existing systems. In existing systems, where brackets are not coated in a material corresponding to the membrane patch, no seal is made between membrane patch and bracket base plate. Rather, a seal is only achieved between the membrane patch and the membrane roof around the perimeter of the bracket base. In existing systems, the mounting system will either be applied over the roof area where wood blocking was originally installed, or the membrane roof would be cut out and a piece of the wood blocking replaced in the area where the base plate would need to be secured, then patched. Adhesives are then used to secure membrane patch, and these adhesives are considered to be a maintenance item. Existing systems thus do not as effectively prevent water from seeping beneath the membrane patch at the area where it is covering and adhered to, but not hot-air welded to, the bracket. Water can then seep through holes in bracket base, arm and/or around the edge of the bracket and into the roof layers below. In existing systems, manufactures will not warranty from water damage where full seal is not achieved. In the present invention, a hot-air weld performed under manufacturer guidelines can be considered a warrantable detail. The present invention thus provides a complete seal that will allow the roof to maintain its warranty.

Figure 4:
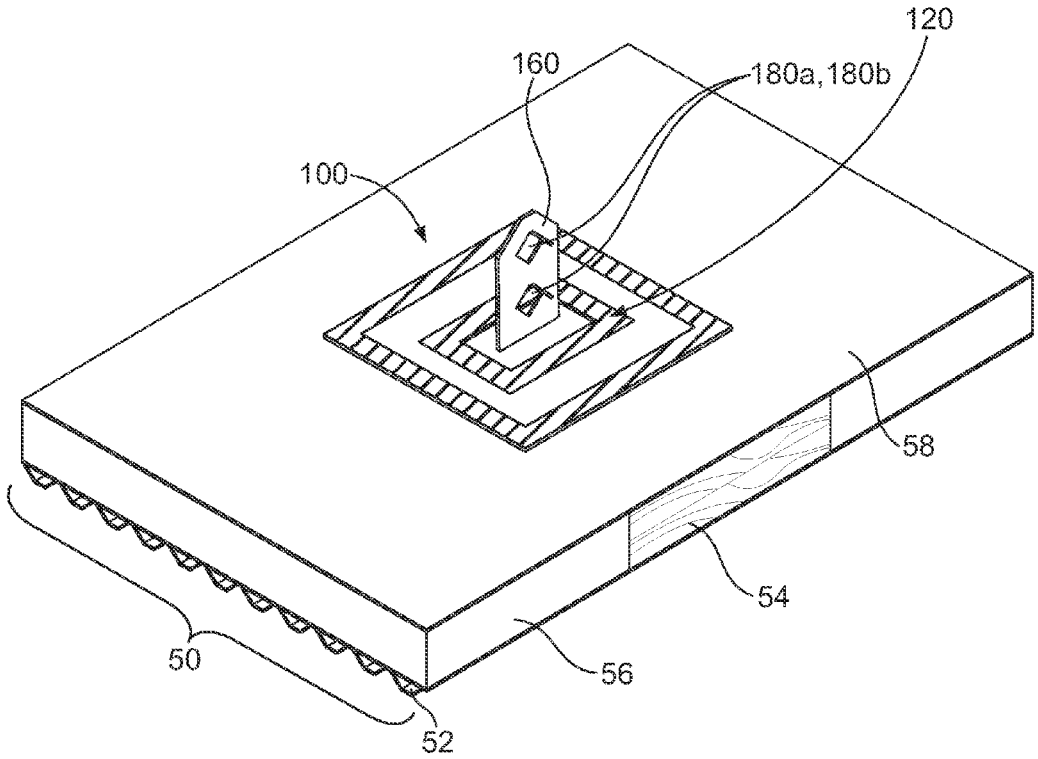
FIG. 4 is a perspective view of another embodiment of a mounting system installed on a roof system in accordance with the present invention.
Figure 5:
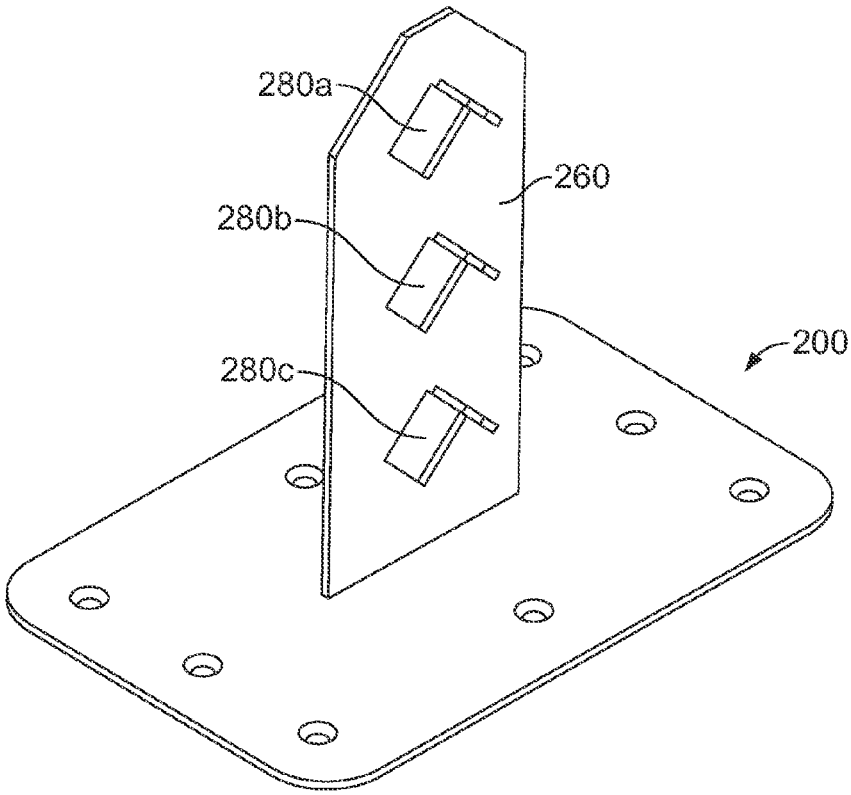
FIG. 5 is a perspective view of a bracket as used in yet another embodiment of a mounting system in accordance with the present invention.
Figure 6:
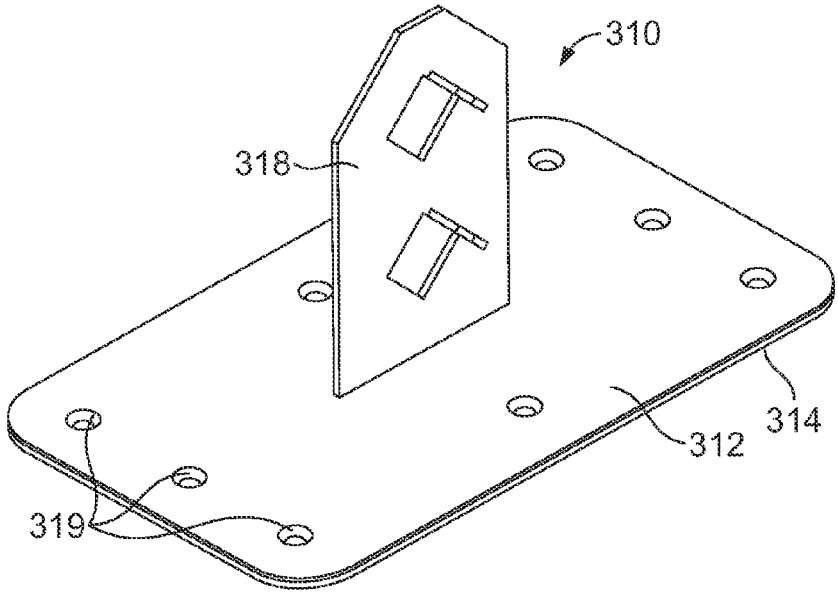
FIG. 6 is a perspective view of a bracket as used with an alternative embodiment of a mounting system for installing on a roof system in accordance with the present invention.

FIG. 4 shows an alternative embodiment of a mounting system 100 where bracket arm 160 includes two apertures 180*a*, 180*b* for inserting two tubes to form snow barricade. FIG. 5 shows yet another alternative embodiment of a bracket 200 having an arm 260 with three apertures 280*a*, 280*b*, 280*c* for receiving three tubes. Additional configurations of arm 16 with varying number and placement of apertures 18 may also be used to achieve the desired tubing arrangement for snow barricade.

Figure 7:
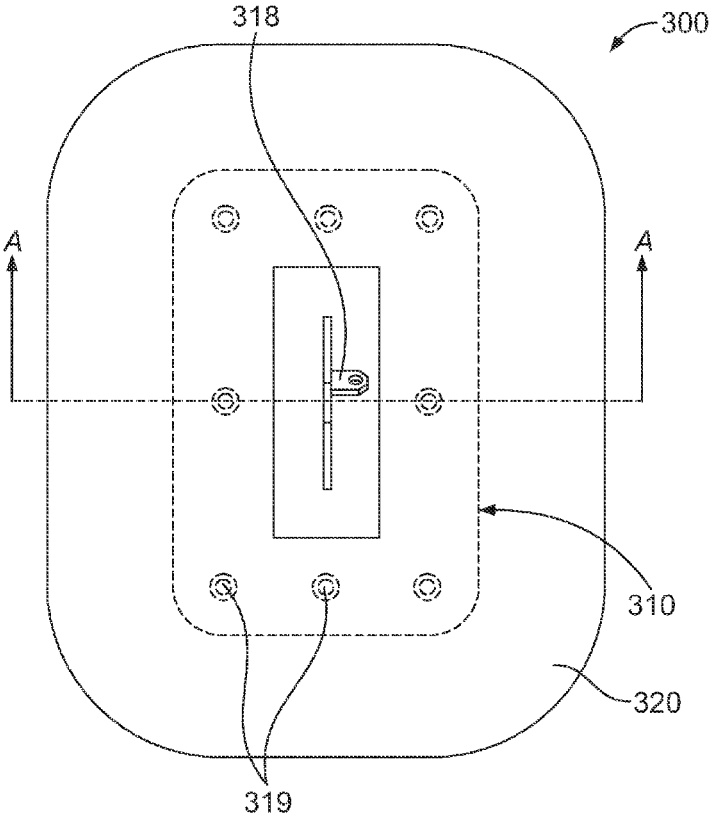
FIG. 7 is a top view of a mounting system in accordance with the embodiment of FIG. 6.
Figure 8:
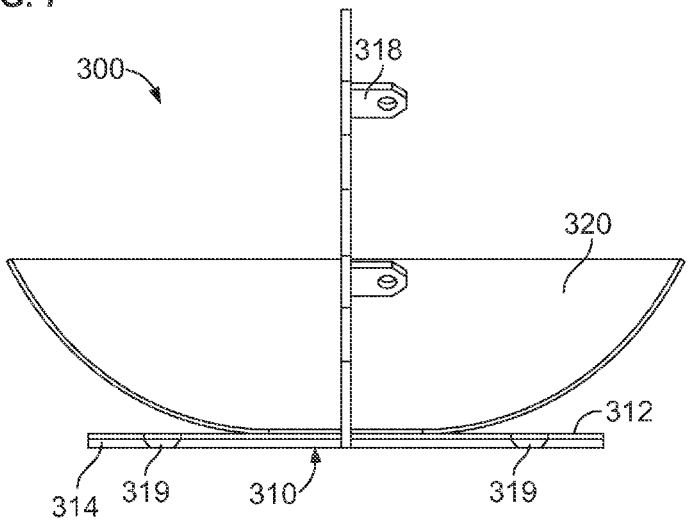
FIG. 8 is a cross-section along line A of FIG. 7 showing membrane patch folded upward to expose holes for fasting bracket to roof.
Figure 9:
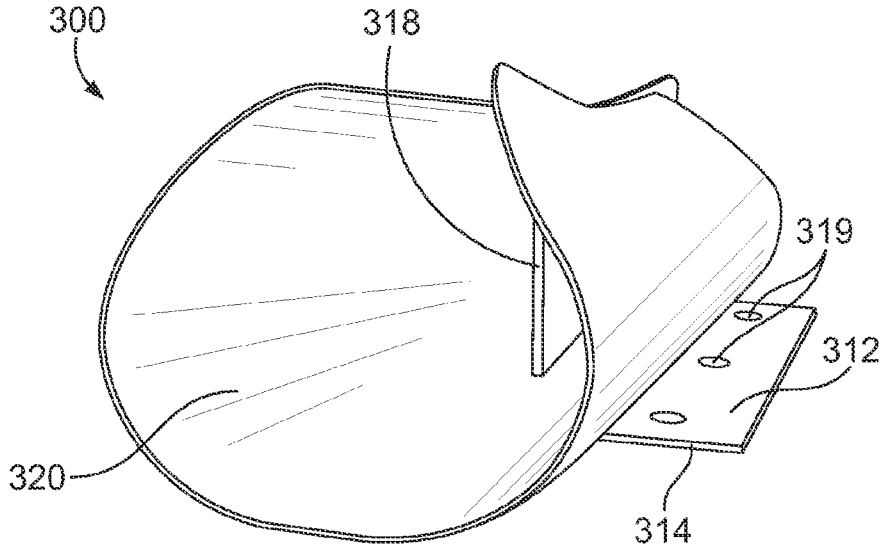
FIG. 9 is a front perspective view of a mounting system in accordance with the embodiment of FIG. 6 showing membrane patch folded upward to expose holes for fasting bracket to roof.
Figure 10:
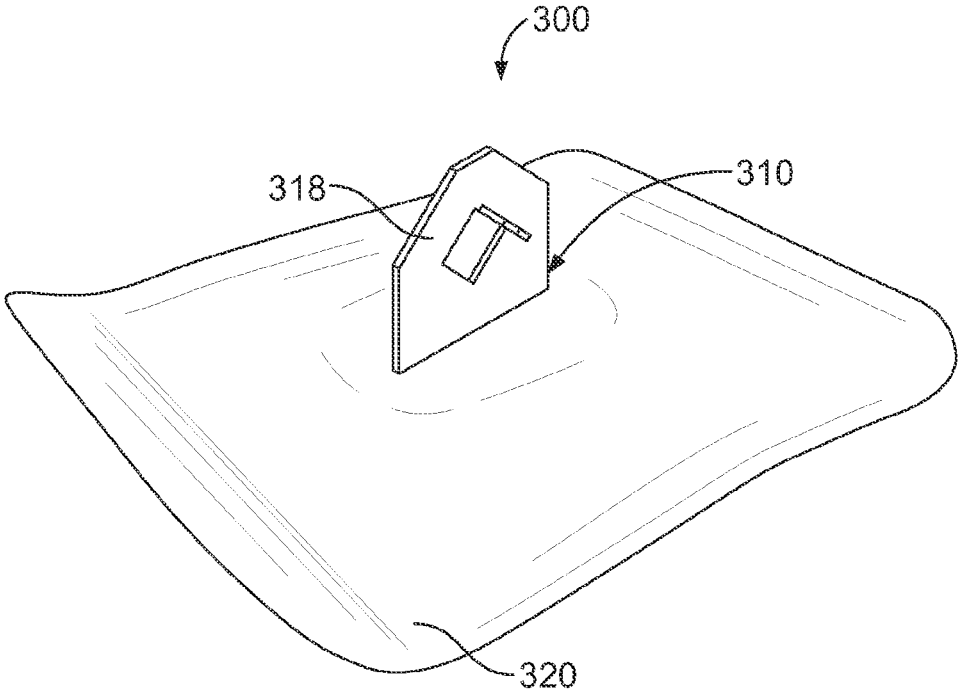
FIG. 10 is a perspective view of a mounting system in accordance with the embodiment of FIG. 6.
Figure 11:
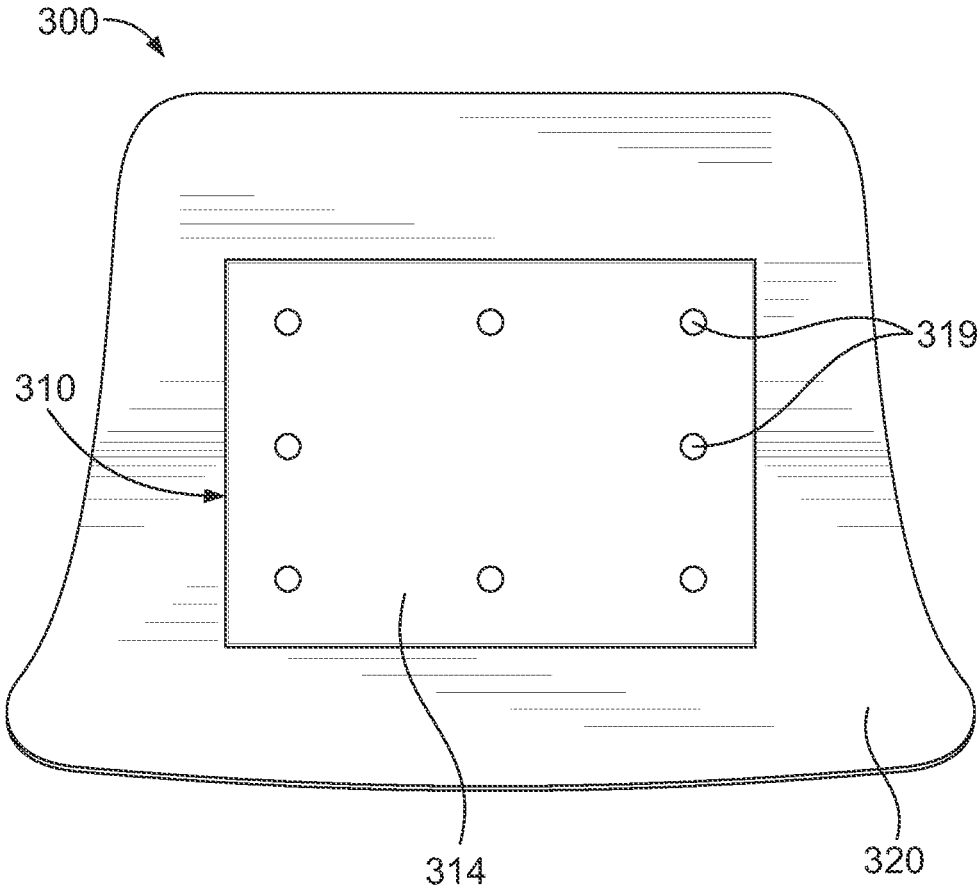
FIG. 11 is a bottom view of a mounting system in accordance with the embodiment of FIG. 6.

A further alternative embodiment of a snow barricade mounting system 300 is shown in FIGS. 6-11. In this embodiment, a sheet of PVC, TPO or similar material 312 corresponding to the material of the membrane roof (not shown) is secured to base plate to form a cladded base plate 314. The TPO and PVC coating can be applied in a spray or dipped process. Arm 318 is then welded or similarly secured to base plate 314 to form bracket 310. In this embodiment, a portion of a membrane patch 320 is pre-applied to a portion of the cladded base plate 314. As seen in FIGS. 7-9, a portion of the membrane patch 320 is secured to a portion of the sheet 312 on base plate 314. The bracket 310 is thus provided to users with the pre-applied membrane patch 320 already secured to the bracket 310. This provides an additional advantage, as the user only need install a single assembly (bracket 310 with pre-applied membrane patch 320) to the roof system. As shown in FIGS. 8-9, the unsecured portion of the membrane patch 320 can be folded up by the installer to expose the holes 319 in base plate 314 for securing the base plate 314 to the roof. As shown in FIG. 11, patch 320 may be sized to cover the holes 319 in the base plate 314 and allow for enough material to either neck up on the arm 318, or at minimum allow for a 1-1.5 inches weld between the edge of the hole 319 to the opening where the patch 320 meets the patch ends. In this embodiment, the outside edge of the patch 320 will overlap the base plate 314 by approximately 2.5 inches.

Bracket 310 is then secured to roof using fasteners (not shown), and a user then hot-air welds the remaining surface of the pre-applied membrane patch 320 to the sheet 312 on the remaining area of the cladded base plate 314 and the membrane layer around the perimeter of the base plate 314. An automated welding machine may be used to pre-apply the portion of the membrane patch 20 to the portion of the cladded base plate 314, with the weld between the membrane patch 320 and the membrane layer done by the contractor in the field with a roller and leister gun. Similar to the embodiment described above, cladding base plate 314 with sheet of material 312 corresponding to the membrane patch 320 provides an advantage over existing systems because a complete seal can be achieved between mounting system 300 and roof system. When membrane patch 320 is secured to sheet 312 on base plate 314 and to membrane layer around the perimeter of the base plate 314, a complete seal between both the membrane patch 320 and the base plate 314, and between the membrane patch 320 and the membrane layer, are achieved. The entire area of the underside of the membrane patch 320 is thus sealed to a surface below (either cladded base plate 314 or membrane layer of roof). This provides a more complete seal than that of existing systems.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. A system for mounting a snow barricade on membrane roof system with a membrane layer, the system comprising:

a bracket comprising:

a base plate, the base plate having one or more holes;

an arm extending upwardly from the base plate, the arm having one or more apertures; and a bracket coating applied to at least a portion of the bracket, the bracket coating material corresponding to membrane layer material;

a means for securing the coated bracket to membrane roof; and a membrane patch comprised of a material compatible with the bracket coating material and the membrane layer material and having a larger perimeter than the perimeter of the base plate, wherein the membrane patch is placed over and sealed to the coated bracket and to the membrane layer around the perimeter of the base plate to form a mounting system having a water-tight seal.

2. The system of claim 1 wherein the means for securing bracket comprises inserting fasteners through holes in base plate, said fasteners penetrating membrane layer and securing into a roof deck below membrane layer.

3. The system of claim 2 wherein the fasteners comprise screws.

4. The system of claim 1 wherein membrane patch further includes a notch to accommodate arm of bracket when membrane patch is placed over base plate.

5. The system of claim 1 wherein the bracket coating material is polyvinyl chloride.

6. The system of claim 1 wherein the bracket coating material is thermoplastic polyolefin.

7. The system of claim 1 wherein membrane patch is sealed to base plate and membrane layer using hot-air welding.

8. A method of securing a snow barricade mounting system on a roof having a membrane layer, the method comprising the steps of:

(i) coating a bracket having a base plate with material corresponding to the material of the membrane layer material;

(ii) mounting the coated bracket to the roof with attachment means that penetrate the membrane layer;

(iii) placing a membrane patch comprised of a material compatible with the bracket coating material and the membrane layer material over the base plate of the bracket; and (iv) sealing the membrane patch to the coating on the base plate of the bracket and to the membrane layer around the perimeter of the base plate to form a mounting system having a water-tight seal.

9. The method of claim 8 wherein bracket is mounted to the roof by attachment means comprising fasteners inserted through holes in base plate, said fasteners penetrating membrane layer and into a roof deck below the membrane layer.

10. The method of claim 8, wherein bracket coating material is polyvinyl chloride.

11. The system of claim 8 wherein the bracket coating material is thermoplastic polyolefin.

12. The method of claim 8, wherein membrane patch is sealed to base plate and membrane layer using hot-air welding.

13. A method of securing a snow barricade mounting system on a roof having a membrane layer, the method comprising the steps of:

(i) coating a bracket with material corresponding to the material of the membrane layer material;

(ii) placing a membrane patch comprised of a material corresponding to the bracket coating material and the membrane layer material over the coated bracket;

(iii) sealing a portion of the membrane patch to a portion of the coated bracket;

(iv) mounting the coated bracket with a portion of the membrane patch sealed thereto to the roof with attachment means that penetrate the membrane layer; and (v) sealing the remainder of the membrane patch to the remaining portion of the coated bracket and to the membrane layer material around the perimeter of the coated bracket to form a mounting system having a water-tight seal.

14. A system for mounting a snow barricade on a roof system with a membrane layer, the system comprising:

a bracket comprising:

a base plate, the base plate having one or more holes; and an arm extending upwardly from the base plate, the arm having one or more apertures;

a sheet of material corresponding to the membrane layer material sealed to the top side of the base plate;

a membrane patch comprised of a material corresponding to the sheet material and to the membrane layer material and having a larger perimeter than the perimeter of the base plate, wherein a portion of the membrane patch is sealed to the sheet material on a portion of the base plate prior to securing of the bracket to membrane roof system;

a means for securing the bracket to the membrane roof system; and wherein the membrane patch is sealed to the sheet material on the remaining portion of the base plate and to the membrane layer around the perimeter of the base plate to form a mounting system having a water-tight seal.

15. A method of securing a snow barricade mounting system on a roof having a membrane layer, the method comprising the steps of:

(i) securing a sheet of material compatible with the membrane layer material to the top side of a base plate of a bracket;

(ii) placing a membrane patch comprised of a material corresponding to the sheet material and the membrane layer material over the base plate;

(iii) sealing a portion of the membrane patch to a portion of the sheet material;

(iv) mounting the bracket with the sheet of material and a portion of the membrane patch sealed thereto to the roof; and (v) sealing the membrane patch to the sheet material on the remaining portion of the base plate and to the membrane layer material around the perimeter of the base plate to form a mounting system having a water-tight seal.

* * * * *